US008974877B2

(12) United States Patent
Gane et al.

(10) Patent No.: US 8,974,877 B2
(45) Date of Patent: Mar. 10, 2015

(54) PAPER FOR INKJET RECORDING

(75) Inventors: Patrick A. C. Gane, Rothrist (CH); Vesa Kukkamo, Zürich (CH); Catherine Jean Ridgway, Mühlethal (CH)

(73) Assignee: Omya International AG, Oftringen (CH)

( * ) Notice: Subject to any disclaimer, the term of this patent is extended or adjusted under 35 U.S.C. 154(b) by 78 days.

(21) Appl. No.: 13/703,673

(22) PCT Filed: Jun. 30, 2011

(86) PCT No.: PCT/EP2011/061008

§ 371 (c)(1),
(2), (4) Date: Jan. 23, 2013

(87) PCT Pub. No.: WO2012/001104

PCT Pub. Date: Jan. 5, 2012

(65) Prior Publication Data

US 2013/0209708 A1 Aug. 15, 2013

Related U.S. Application Data

(60) Provisional application No. 61/399,273, filed on Jul. 9, 2010.

(30) Foreign Application Priority Data

Jul. 2, 2010 (EP) ..... 10168352

(51) Int. Cl.

| | |
|---|---|
| ***B41M 5/00*** | (2006.01) |
| ***B41M 5/50*** | (2006.01) |
| ***D21H 19/82*** | (2006.01) |
| ***B41M 5/52*** | (2006.01) |

(52) U.S. Cl.

CPC ..... *B41M 5/502* (2013.01); *D21H 19/82* (2013.01); *D21H 19/822* (2013.01); *B41M 5/508* (2013.01); *B41M 5/5218* (2013.01); *B41M 5/5254* (2013.01)

USPC ..... 428/32.22; 428/32.24; 428/32.25; 428/32.28; 428/32.31; 428/32.34

(58) Field of Classification Search

CPC .... B41M 5/504; B41M 5/508; B41M 5/5254; B41M 5/506; B41M 5/5218; B41M 5/502

USPC ..... 428/32.22, 32.24, 32.25, 32.28, 32.31, 428/32.34

See application file for complete search history.

(56) References Cited

U.S. PATENT DOCUMENTS

| | | | | |
|---|---|---|---|---|
| 4,642,247 | A | 2/1987 | Mouri et al. | |
| 5,007,964 | A | 4/1991 | Tsukisaka et al. | |
| 5,783,038 | A | 7/1998 | Donigian et al. | |
| 6,335,085 | B1 * | 1/2002 | Asano et al. | 428/32.25 |
| 6,666,953 | B1 | 12/2003 | Gane et al. | |
| 2005/0276935 | A1 * | 12/2005 | Toda et al. | 428/32.34 |
| 2006/0172093 | A1 | 8/2006 | Watanabe et al. | |
| 2009/0044819 | A1 | 2/2009 | Fritzsching | |
| 2009/0123676 | A1 | 5/2009 | Kato et al. | |

FOREIGN PATENT DOCUMENTS

| | | | |
|---|---|---|---|
| CN | 1800491 | A | 7/2006 |
| DE | 102004050960 | A1 | 5/2006 |
| DE | 112004001339 | B4 | 6/2009 |
| EP | 0743193 | A1 | 11/1996 |
| EP | 1108559 | A1 | 6/2001 |
| EP | 1712523 | A1 | 10/2006 |
| EP | 1806236 | A1 | 7/2007 |
| WO | 9849261 | A1 | 11/1998 |
| WO | 9902608 | A1 | 1/1999 |
| WO | 9952984 | A1 | 10/1999 |
| WO | 0039222 | A1 | 7/2000 |
| WO | 0104218 | A1 | 1/2001 |
| WO | 0177273 | A1 | 10/2001 |
| WO | 2004083316 | A1 | 9/2004 |
| WO | 2005121257 | A2 | 12/2005 |
| WO | 2006109168 | A2 | 10/2006 |
| WO | 2006109171 | A1 | 10/2006 |
| WO | 2007070259 | A1 | 6/2007 |
| WO | 2007108911 | A1 | 9/2007 |
| WO | 2009074492 | A1 | 6/2009 |
| WO | 2009095697 | A1 | 8/2009 |
| WO | 10029403 | A1 | 3/2010 |

OTHER PUBLICATIONS

The International Search Report, dated Jul. 26, 2011 for PCT Application No. PCT/EP2011/061008.

The Written Opinion of teh International Searching Authority, dated Jul. 26, 2011 for PCT Application No. PCT/EP2011/061008.

The Notice of Opposition dated Sep. 4, 2012for European Patent No. 2402167.

Schoelkopf et al. "Measurement and network modeling of liquid permeation into compacted mineral blocks." Journal of Colloid and Interface Science 227, 119-131 (2000).

Ridgway et al. "Modified calcium carbonate coatings with absorption and extensive liquid uptake capacity." Colloids and Surfaces A: Physicochem. Eng. Aspects 236 (2004) 91-102.

Ridgway et al. "A new method for measuring the liquid permeability of coated and uncoated papers and boards." Nordic Pulp and Paper Research Journal vol. 18, No. Apr. 2003, pp. 377-381.

Vucak et al. "Plättchenförmiges PCC: ein einzigartiges Streichpigment für Inkjet-Papier?" Wochenblatt für PapierFabrikation 22 (2003), pp. 1370-1374.

Kogler "Erfahrungen bei der Papierveredelung durch Einsatz von Calcoumcarbonaten mit optimierten Eigenschaften." 2004.

Vucak et al. "Application of novel plate-shaped calcium carbonate in inkjet paper coating." Science and Technology, Das Papier ipw Apr. 2004.

Vucak et al. "Application of novel plate-shaped calcium carbonate in inkjet paper coating." Science and Technology, Das Papier ipw May 2004 (continuation from ipw Das Papier Apr. 2004).

Vucak et al. "Vortragsband Proceedings." 21st PTS Coatings Symposium 2003.

* cited by examiner

*Primary Examiner* — Betelhem Shewareged

(74) *Attorney, Agent, or Firm* — Amster, Rothstein & Ebenstein LLP

(57) ABSTRACT

The present invention concerns a print medium for inkjet printing and a method of producing such a print medium. In particular, the present invention is directed to a print medium comprising a base layer having a first side and a reverse side, an absorptive layer being in contact with the first side of the base layer, and a topcoat being in contact with the absorptive layer.

28 Claims, 4 Drawing Sheets

PAPER FOR INKJET RECORDING

CROSS-REFERENCE TO RELATED APPLICATIONS

This application is a U.S. national phase of PCT Application No. PCT/EP2011/061008, filed Jun. 30, 2011, which claims priority to European Application No. 10168352.2, filed Jul. 2, 2010 and U.S. Provisional Application No. 61/399,273, filed Jul. 9, 2010.

The present invention relates to the field of contactless printing, and more specifically to a print medium for inkjet printing and a method of producing such a print medium.

Digital printing is the fastest growing segment in the field of graphical communication. It is a value added approach compared to traditional printing methods by offering on-demand printing at low costs and low environmental impacts. In addition, personalized print works can be used as a promotional material for direct marketing and publishing. As a consequence of the new technology the print speeds and the print quality has been lifted up to a level where traditional offset printing can really be challenged.

Typically glossy paper grades for publishing and commercial printing are printed in offset printing. Such papers generally contain a coating comprising a pigment such as calcium carbonate together with a binder such as styrene-butadiene latex. Technically it has been impossible to use glossy offset papers in inkjet printing, mainly due to low absorption capacity of the paper coating and anionic surface charge. These drawbacks are known to lead to high colour to colour bleed and mottling when printing with inkjet technology.

On the other hand, it has been as well impossible to produce coated glossy inkjet papers with conventional big paper coating machines that are designed for producing offset papers. This is mainly due to the fact that inkjet quality coated papers possess absorptive pre- and topcoats, such as precoats consisting of highly porous precipitated silica and topcoats based on super-absorptive polymers, either or both having poor rheology, low solids and in the case of end-use with dye-based inks a cationic character. Furthermore, the current inkjet papers are over-engineered for future printing needs, since the absorption capacity is higher than required by the new printing technology. The current products are also very expensive to produce since they all use special materials like the abovementioned silica pigment, and high amounts of special binders and additives. Furthermore, severe rheological limitations associated with silica reduce the amount of coating solids and increase Brookfield viscosity.

An inkjet recording medium comprising a porous base layer with precipitated calcium carbonate is described in EP 1996408 and EP 1963445.

WO 2009/095697 describes a coated paper sheet for inkjet printing comprising a pigment, a binder, a binder comprising a major proportion of the polymer carrying —O—, —CO—, —OCO— and/or —COO— groups in its side chains, and a water-soluble salt of a Group II, Group III or transition metal.

For completeness, the Applicant would like to mention the following applications in its name, which generally refer to pigments suitable for use in paper, and notably paper coating formulations: WO 99/52984, WO 00/39222, WO 01/04218, WO 2004/083316, WO 2006/109168, WO 2006/109171, WO 2010/029403, unpublished European patent application with filing number 09170864.4, unpublished European patent application with filing number 10003665.6.

There remains a need in the art for a high quality print medium which can be used with good effect in inkjet printers and which can be manufactured on a standard paper coating machine.

Accordingly, it is an object of the present invention to provide a print medium that is suitable for inkjet printing and meets more commodity-needs and can be manufactured at lower costs when compared to today's inkjet coating formulations.

Another object of the present invention is to provide a print medium that can be manufactured on a standard paper coating machine producing offset paper grades. Still another object of the present invention is to provide a print medium having excellent runnability on big paper coating machines. It would also be desirable to provide a print medium that can be manufactured on a standard high-speed big paper coating machine.

It would also be desirable to provide a print medium that is suitable for high-definition printing uses and is applicable to high-speed inkjet printing. It would also be desirable to provide a print medium that is still suitable for photocopying, which allows multiple uses of the paper.

The foregoing and other objects are solved by the provision of a print medium comprising a base layer having a first side and a reverse side, an absorptive layer being in contact with the first side of the base layer, and a topcoat being in contact with the absorptive layer, wherein the topcoat has a permeability of greater than $5.0\times10^{-18}$ $m^2$.

The base layer can serve as a support for the absorptive layer and the topcoat. The function of the absorptive layer is to absorb ink solvent which is applied to the print medium in course of the printing process, while the purpose of the topcoat is to create a functional layer that acts as either a filter for ink, capturing the pigmented ink particles but allowing the solvent to go through to be absorbed by the absorptive layer, or for providing an adsorptive surface for fixing dye-based inks.

According to another aspect of the present invention, a method for manufacturing a print medium is provided comprising the following steps:

a) providing a base layer having a first side and a reverse side;
b) applying a liquid coating formulation to form an absorptive layer on the first side of the base layer;
c) applying a liquid coating formulation onto the absorptive layer to form a topcoat; and
d) drying the absorptive layer and the topcoat, wherein the absorptive layer and the topcoat are either dried simultaneously or the absorptive layer is dried after step b) and before applying the topcoat according to step c), wherein the topcoat has a permeability of greater than $5.0\times10^{-18}$ $m^2$.

Advantageous embodiments of the present invention are defined in the corresponding sub-claims.

According to one embodiment the base layer is a wood free paper or a wood containing paper, preferably having a basis weight from 30 to 300 g/$m^2$. According to another embodiment the absorptive layer has an absorption rate from $1\times10^{-5}$ $ms^{-0.5}$ to $1\times10^{-3}$ $ms^{-0.5}$ and/or a volume uptake from 30 to 95% by volume relative to the total volume of the absorptive layer.

According to one embodiment the absorptive layer comprises a pigment, which, when in the form of a compacted bed, has an absorption rate from $1\times10^{-5}$ $ms^{-0.5}$ to $1\times10^{-3}$ $ms^{0.5}$ and/or a volume uptake from 35 to 95% by volume relative to the total volume of the pigment. According to another embodiment the pigment has a specific surface area of greater than 25 $m^2$/g, preferably from 25 to 100 $m^2$/g or from 30 to 50 $m^2/g$. According to still another embodiment, the pigment has a specific surface area of greater than 25 $m^2/g$, a $d_{50}$ value from 0.3 to 3 μm and a porosity, when in form of a compacted bed, of greater or equal to 35%. According to still another embodiment the pigment is a calcium carbonate, a plastic pigment such as a polystyrene-based plastic pigment, titanium dioxide, dolomite, calcined clay, or mixture thereof, or wherein the pigment is a mixture of calcium carbonate, titanium dioxide, dolomite, calcined clay or mixtures thereof with one or more of talc, non-calcined clay or bentonite, said pigment being preferably a calcium carbonate, more preferably a modified calcium carbonate and/or a precipitated calcium carbonate. According to still another embodiment the calcium carbonate is in acicular, prismatic, spheral, or rhombohedral form or any combination thereof.

According to one embodiment the absorptive layer further contains a binder, preferably in an amount of 1 to 50 wt.-% based on the total weight of the pigment. According to another embodiment the binder is selected from starch, polyvinylalcohol, styrene-butadiene latex, styrene-acrylate latex, or polyvinyl acetate latex or a mixture thereof. According to still another embodiment the absorptive layer has a coat weight in a range from 3 to 50 $g/m^2$, preferably 3 to 40 $g/m^2$, and most preferably from 6 to 20 $g/m^2$.

According to one embodiment the topcoat comprises a pigment having a $d_{50}$ value in a range from 0.01 to 1.0 μm. According to another embodiment the topcoat further contains a binder, preferably in an amount of 0.5 to 50 wt.-% based on the total weight of the pigment. According to still another embodiment the binder is selected from starch, polyvinylalcohol, styrene-butadiene latex, styrene-acrylate latex, or polyvinyl acetate latex or a mixture thereof. According to still another embodiment the topcoat further comprises a rheology modifier in an amount of less than 1 wt.-% based on the total weight of the pigment. According to still another embodiment the topcoat has a coat weight in a range from 1 to 50 $g/m^2$, preferably 3 to 40 $g/m^2$, and most preferably from 6 to 20 $g/m^2$.

According to one embodiment the print medium further comprises a second absorptive layer being in contact with the reverse side of the base layer, and a second topcoat being in contact with the second absorptive layer.

According to one embodiment steps b) to d) of the inventive method are also carried out on the reverse side of the base layer to manufacture a print medium being coated on the first side and the reverse side. According to another embodiment the liquid coating formulation used to form an absorptive layer and/or a topcoat has a solid content of 10 to 80 wt.-%, preferably of 30 to 60 wt.-%, and more preferably of 45 to 55 wt.-% based on the total weight of the formulation. According to still another embodiment the liquid coating formulation used to form an absorptive layer further contains a dispersant, preferably polyacrylate, in an amount of 0.05 to 5 wt.-%, and preferably in an amount of 0.5 to 5 wt.-%, based on total weight of the pigment.

According to one embodiment the coating formulations are prepared using aqueous suspension of dispersed calcium carbonate having a solid content between 10 wt.-% and 82 wt.-%, preferably between 50 wt.-% and 81 wt.-%, and more preferably between 70 wt.-% and 78 wt.-%, based on the total weight of the aqueous suspension of dispersed calcium carbonate. According to another embodiment the coating formulations have a viscosity in the range of 20 to 3000 mPas, preferably 250 to 3000 mPas, and more preferably 1000 to 2500 mPas. According to still another embodiment the coating formulations are applied by high speed coating, meter size press, curtain coating, spray coating, or electrostatic coating, and preferably by high speed coating.

Figure 1:
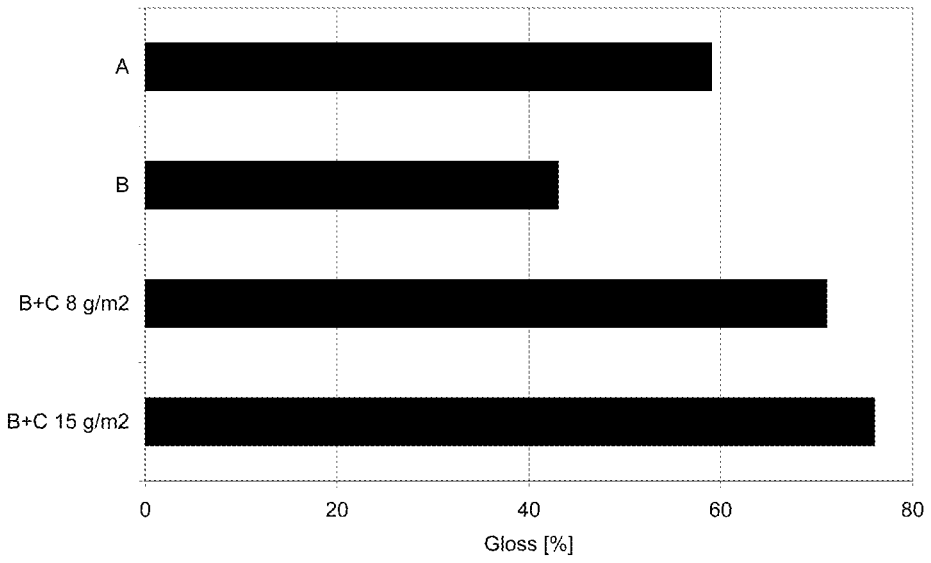
FIG. 1 shows the paper gloss that was measured for paper sheets having different coating formulations being calendered at 300 kN/m.
Figure 2:
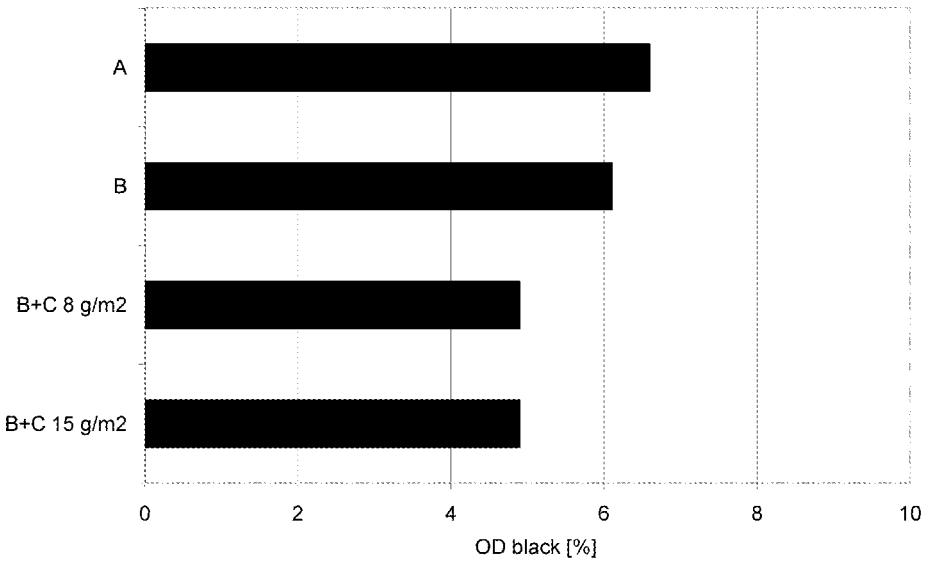
FIG. 2 shows the optical density upon black inkjet printing that was measured for paper sheets having different coating formulations.
Figure 3:
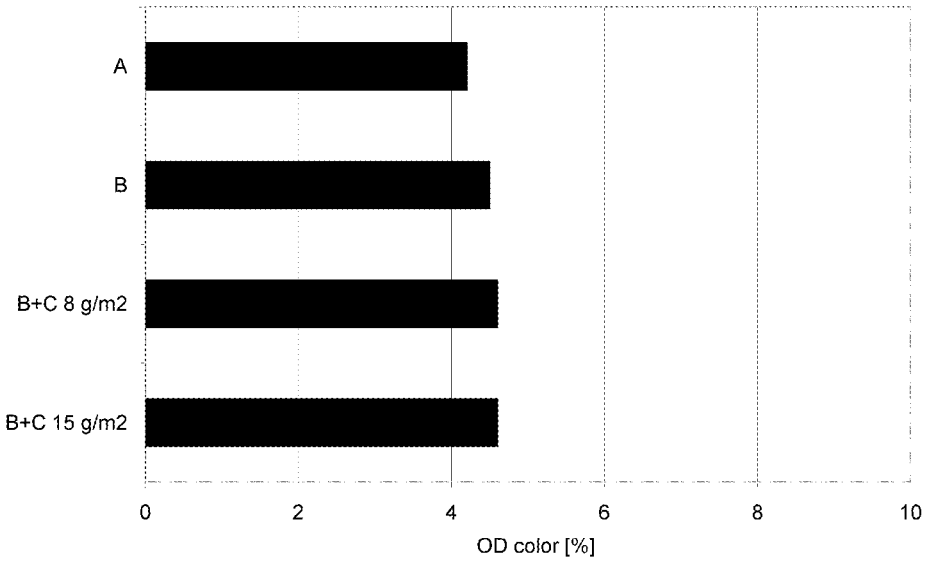
FIG. 3 shows the optical density upon color inkjet printing that was measured for paper sheets having different coating formulations.
Figure 4:
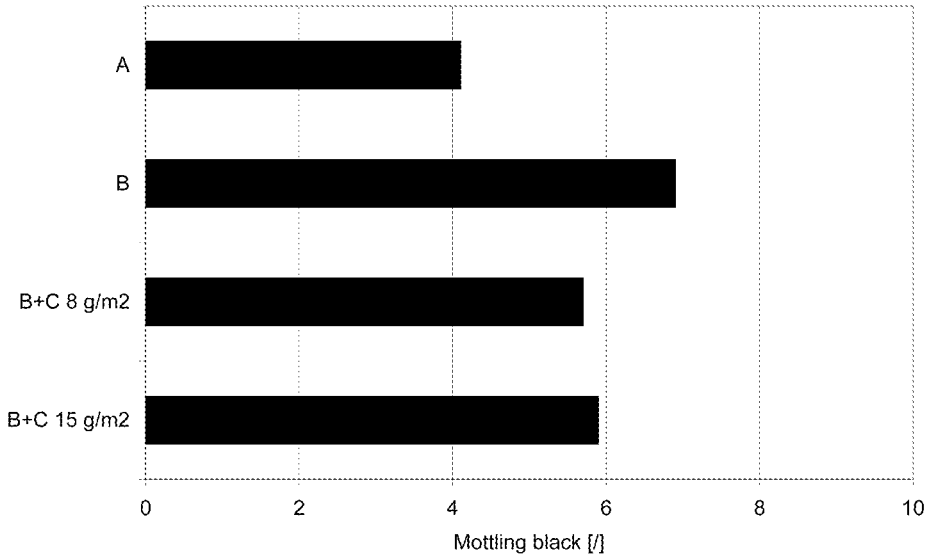
FIG. 4 shows the mottling upon black inkjet printing that was measured for paper sheets having different coating formulations.

For the purpose of the present invention, the term "absorption rate" is a measure for the amount of liquid that can be absorbed by a coating or a pigment within a certain time. As used herein, the absorption rate is expressed as a linear relationship between V(t)/A and √t, the gradient of which is $$\frac{d(V(t)/A)}{d\sqrt{t}} = \frac{d((m(t)/\rho)/A)}{d\sqrt{t}}$$

where m(t) is the mass uptake at time t, as defined by a volume V(t) of liquid of density ρ. The data are normalized to the cross-sectional area of the sample, A, such that the data become V(t)/A, the volume absorbed per unit cross-sectional area of the sample. The gradient can be obtained directly from the plotted data by a linear regression analysis, and gives an absorption rate of the liquid uptake. The absorption rate is specified in $ms^{-0.5}$. An apparatus that can be used to determine the absorption rate is described in Schoelkopf et al. "Measurement and network modelling of liquid permeation into compacted mineral blocks". Journal of Colloid and Interface Science 2000, 227(1), 119-131).

"Air permeance" in the meaning of the present invention is a characteristic of a paper's internal structure and can indicate how ink will penetrate the sheet under pressure or independent wetting. As used herein, the air permeability is specified in ml/min.

The term "basis weight" as used in the present invention is defined as the weight of 500 sheets in its basic size and specified in $g/m^2$.

The term "brightness" as used in the context of the present invention is a measurement of the percentage of diffuse light reflected from a paper's surface. A brighter sheet reflects more light. As used herein, brightness of the paper may be measured at a mean wavelength of light of 457 nm and is specified in percent.

For the purposes of the present invention, the term "coating" refers to one or more layers, coverings, films, skins, etc, formed, created, prepared, etc., from a coating formulation which remains predominantly on the surface of the print medium. The term "color to color bleed" as used in the context of the present invention describes the mixing of two dissimilar colors in two adjacent printed areas or dots, depending on desired tone, before they dry and absorb into substrate. Color to color bleed reduces print quality.

For the purposes of the present invention, the term "gloss" refers to the ability of paper to reflect some portion of the incident light at the mirror angle. Gloss may be based on a measurement of the quantity of light specularly reflected from the surface of a paper specimen at a set angle, for example, at 75°, such as in the case of 75° gloss and is specified in percent.

"Ground calcium carbonate" (GCC) in the meaning of the present invention is a calcium carbonate obtained from natural sources including marble, chalk or limestone, and processed through a treatment such as grinding, screening and/or fractionizing by wet and/or dry, for example, by a cyclone.

For the purposes of the present invention, the term "ink jet printing" refers to a digital printing technology, method, device, etc., that may form images on paper by spraying, jetting, etc., tiny droplets of liquid inks onto the paper through the printer nozzles. The size (e.g., smaller size), precise placement, etc., of the ink droplets may be used to provide higher quality inkjet prints. Ink jet printing may include continuous ink jet printing, drop-on-demand ink jet printing, etc.

For the purposes of the present invention, the term "mottling" refers to non-uniformity in the print image which may be due to unevenness in ink lay, non-uniform ink absorption, etc., across the paper surface.

The term "optical print density" as used in the context of the present invention is a measure of the extent to which a printed area transmits the selected filtered light, measured in back-scatter mode. The optical density is a dimension for the thickness of the colour layer above the substrate. Optical density values are calculated based on the spectral measurement, therefore slight differences to the measurement with a densitometer may occur. The calculation is made according to the DIN Norm 16536-2. The optical print density is measured using a Gretag-Macbeth Spektrolino.

"Opacity" in the meaning of the present invention is a measure of the percentage of light passing through a sheet of paper. The more opaque a paper is, the less show through there will be from printing on the sheet below. As used herein, the opacity is specified in percent.

For the purposes of the present invention, the term "paper smoothness" refers to the extent to which the surface of a (coated) print medium deviates from a planar or substantially planar surface. As used herein, the smoothness of a paper surface is measured by, for example, in terms of "Parker print smoothness" and is specified in μm.

Throughout the present document, the "particle size" of a pigment is described by its distribution of particle sizes. The value $d_x$ represents the diameter relative to which x % by weight of the particles have diameters less than $d_x$. This means that the $d_{20}$ value is the particle size at which 20 wt.-% of all particles are smaller, and the $d_{75}$ value is the particle size at which 75 wt.-% of all particles are smaller. The $d_{50}$ value is thus the weight median particle size, i.e. 50 wt.-% of all grains are bigger or smaller than this particle size. For the purpose of the present invention the particle size is specified as weight median particle size $d_{50}$ unless indicated otherwise. For determining the weight median particle size $d_{50}$ value for particles having a $d_{50}$ greater than 0.5 μm, a Sedigraph 5100 device from the company Micromeritics, USA can be used.

For the purpose of the present invention, the term "permeability" refers to the ease with which a liquid can flow through a tablet of the topcoat. As used herein, the permeability is expressed in terms of the Darcy permeability constant, k, as $$\frac{dV(t)}{dt} = \frac{-kA\Delta P}{\eta l}$$

where dV(t)/dt is defined as the flux or volume flow rate per unit cross-sectional area, A, ΔP is the applied pressure difference across the sample, η is the viscosity of the liquid and l is the length of the sample. The data are reported in terms of k in $m^2$. A detailed description for a permeability measurement method can be found in Ridgway et al. "A new method for measuring the liquid permeability of coated and uncoated papers and boards" (Nordic Pulp and Paper Research Journal 2003, 18(4), 377-381).

A "pigment" in the meaning of the present invention can be a mineral pigment or a synthetic pigment. For the purpose of the present invention, a "mineral pigment" is a solid substance having a definite chemical composition and characteristic crystalline structure, while a "synthetic pigment" is, e.g., a plastic pigment based on a polymer. For the purpose of the present invention, the absorption rate, porosity and volume uptake of the pigment is determined, when the pigment is in form of a compacted bed, i.e. in form of a tablet formulation. A detailed description for preparing a compacted bed or tablet formulation from pigment suspensions or slurries can be found in Ridgway et al. "Modified calcium carbonate coatings with rapid absorption and extensive liquid uptake capacity" (Colloids and Surfaces A: Physiochem. and Eng. Asp. 2004, 236(1-3), 91-102).

"Precipitated calcium carbonate" (PCC) in the meaning of the present invention is a synthesized material, generally obtained by precipitation following the reaction of carbon dioxide and lime in an aqueous environment or by precipitation of a calcium and carbonate source in water or by precipitation of calcium and carbonate ions, for example $CaCl_2$ and $Na_2CO_3$, out of solution.

The "Porosity" of the coated and dried coating formulations in the meaning of the present invention describes the relative pore volume of paper coatings and is specified in percent. The porosity can be measured using a Micromeritics Autopore IV 9500 mercury porosimeter having a maximum applied pressure of mercury 414 MPa (60000 psia). Equilibration time used at each pressure is 60 seconds. This instrument measures pore diameters in the 0.004 μm-360 μm range.

Mercury porosimetry is based on the physical principle that a non-reactive, non-wetting liquid will not penetrate pores until sufficient pressure is applied to force its entrance. The relationship between the applied pressure and the pore size into which mercury will intrude is given by the Young-Laplace equation:

$$D = \frac{-4\gamma\cos\theta}{P}$$

where P is the applied pressure, D is the diameter of an equivalent capillary, γ is the surface tension of mercury (0.48 $Nm^{-1}$) and θ is the contact angle between mercury and the pore wall, usually taken to be 140°. The required pressure is inversely proportional to the size of the pores, only slight pressure being required to intrude mercury into large micropores, whereas much greater pressures are required to force mercury into nanopores. A detailed description of mercury porosity measurement method can be found in Webb and On, Analytical Methods in Fine Particle Technology, published by Micromeritics Instrument Corporation, 1997, ISBN 0-9656783-0-X.

For the purposes of the present invention, a "rheology modifier" is an additive that improves the runnability of a coating formulation.

A "specific surface area (SSA)" of a mineral pigment in the meaning of the present invention is defined as the surface area of the mineral pigment divided by the mass of the mineral pigment. As used herein, the specific surface area is measured by adsorption using the BET isotherm (ISO 9277:1995) and is specified in $m^2/g$.

For the purposes of the present invention, the "thickness" of a layer refers to the thickness of the layer after the applied coating formulation has been dried.

For the purposes of the present invention, the term "viscosity" with reference to coating formulations, refers to Brookfield viscosity. The Brookfield viscosity may be measured by a Brookfield viscometer at 23° C. at 100 rpm and is specified in mPas.

The term "volume uptake" in the meaning of the present invention refers to the volume of a liquid that can be absorbed by one gram of a porous solid or coating layer. As used herein, the volume uptake is defined as the quotient of the accessible pore volume, such as measured using mercury porosimetry, and the sample mass and is specified in $cm^3/g$. The volume uptake can also be expressed as a percent value by using the following equation:

$$\text{volume uptake } [\%] = \frac{\text{pore volume}}{\text{bulk volume}} \times 100\% = \frac{\text{pore volume}}{\text{pore volume} + \frac{\text{skeletal mass}}{\text{skeletal density}}} \times 100\%$$

wherein the pore volume is calculated from the absolute volume uptake, the skeletal mass equals the coat weight and the skeletal density depends on the used pigment and is 2.7 $g/cm^3$ for carbonate.

The inventive print medium comprises a base layer having a first side and a reverse side, an absorptive layer being in contact with the first side of the base layer, and a top coat being in contact with the absorptive layer, wherein the topcoat has a permeability of greater than $5.0\times10^{-18}$ $m^2$. Optionally, the print medium can further comprise a second absorptive layer being in contact with the reverse side of the base layer, and a second topcoat being in contact with the second absorptive layer. In the following the components or parts of the print medium are described in more detail.

Base Layer

The print medium of the present invention comprises a base layer, which can serve as a support for the absorptive layer and the topcoat and may be opaque, translucent, or transparent. The base layer can be, e.g., a paper substrate, a plastic substrate, a metal foil, cloth or a glass material.

According to one embodiment of the present invention, the base layer is paper substrate. The paper substrate can be a wood free or a wood containing paper. A suitable pulp constituting the paper substrate may be, for example, a natural pulp, a recycled pulp, a synthetic pulp, or the like and mixtures thereof. Into the paper substrate can be incorporated, if necessary, various additives such as a sizing agent, a paper-strength enhancer, a filler, an antistatic agent, a fluorescent whitening agent, and a dye, which are generally used in paper manufacture. Moreover, the paper substrate may be precoated with a surface sizing agent, a surface paper-strength enhancer, a fluorescent whitening agent, an antistatic agent, a dye, an anchoring agent, and the like. If required, the paper substrate may be subjected to a surface smoothing treatment in a usual manner using a calendering apparatus during or after paper-making.

The paper substrate can have a basis weight from 5 to 600 $g/m^2$, from 10 to 500 $g/m^2$, from 20 to 400 $g/m^2$, or from 30 to 300 $g/m^2$.

According to another embodiment, the base layer is a plastic substrate. Suitable plastic materials comprise polyester resins, e.g., poly(ethylene terephthalate), poly(ethylene naphthalate) and poly(ester diacetate), polycarbonate resins, or a fluorine-containing resins, e.g., poly(tetrafluoro ethylene).

The base layer can have a thickness from 1 to 1000 μm, from 10 to 500 μm, or from 50 to 400 μm. According to a preferred embodiment, the base layer has a thickness from 75 to 300 μm, or from 100 to 200 μm.

Absorptive Layer

An absorptive layer is in direct contact with the first side of the base layer, and optionally a second absorptive layer can be in direct contact with the reverse side of the base layer. The function of the absorptive layer is to absorb ink solvent which is applied to the print medium in course of the printing process. The ink compositions used in inkjet printing, for example, typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inkjet inks based on oil as carrier can also be used.

According to one embodiment the absorptive layer has an absorption rate from $1\times10^{-5}$ $ms^{-0.5}$ to $5\times10^{-3}$ $ms^{-0.5}$, more preferably $1\times10^{-4}$ $ms^{-0.5}$ to $5\times10^{-4}$ $ms^{-0.5}$ and/or a volume uptake of from 30 to 95%, preferably 40 to 70%, by volume relative to the total volume of the absorptive layer.

According to one embodiment the absorptive layer comprises a pigment. A suitable pigment is, for example, a pigment, which when formed into a compacted bed, has an absorption rate from $1\times10^{-5}$ $ms^{-0.5}$ to $1\times10^{-3}$ $ms^{0.5}$ and/or a volume uptake of from 35 to 95%, preferably 40 to 70%, by volume relative to the total volume of the pigment.

According to an exemplary embodiment, the pigment has a specific surface area of from 25 to 200 $m^2/g$, e.g., from 25 to 100 $m^2/g$ or from 30 to 50 $m^2/g$.

The pigment may feature a $d_{50}$ value from about 0.1 to 10 μm, from about 0.2 to 6.0 μm, or from about 0.25 to 4.0 μm. Preferably, the pigment has a $d_{50}$ value from about 0.3 to 3.0 μm.

According to one exemplary embodiment, the pigment has a specific surface area of greater than 25 $m^2/g$, a $d_{50}$ value from 0.3 to 3 μm and a porosity, when in the form of a compacted bed, of greater than or equal to 35%.

According to one embodiment of the present invention, the pigment is a mineral pigment. A suitable mineral pigment may be a calcium carbonate, for example, being in the form of a ground calcium carbonate, a modified calcium carbonate or a precipitated calcium carbonate, or a mixture thereof. A natural ground calcium carbonate (GCC) may feature, e.g., one or more of marble, limestone, chalk, and/or dolomite. A precipitated calcium carbonate (PCC) may feature, e.g., one or more of aragonitic, vateritic and/or calcitic mineralogical crystal forms. Aragonite is commonly in the acicular form, whereas vaterite belongs to the hexagonal crystal system. Calcite can form scalenohedral, prismatic, spheral, and rhombohedral forms. A modified calcium carbonate may feature a natural ground or precipitated calcium carbonate with a surface and/or internal structure modification, e.g., the calcium carbonate may be treated or coated with a hydrophobising surface treatment agent such as, e.g. an aliphatic carboxylic acid or a siloxane. Calcium carbonate may be treated or coated to become cationic or anionic with, for example, a polyacrylate or polydadmac.

Preferably the mineral pigment is a modified calcium carbonate or a precipitated calcium carbonate, or a mixture thereof. Examples of calcium carbonates that may be used in the absorptive layer of the present invention are described, e.g., in EP 1712523 or U.S. Pat. No. 6,666,953.

According to one embodiment the calcium carbonate is in acicular, prismatic, spheral, or rhombohedral form or any combination thereof.

According to one embodiment, the calcium carbonate will be derived from an aqueous suspension of dispersed calcium carbonate. According to one embodiment of the present invention, the aqueous suspension of dispersed calcium carbonate has a solid content of between 10 wt.-% and 82 wt.-%, preferably between 50 wt.-% and 81 wt.-%, and more preferably between 70 wt.-% and 78 wt.-%, based on the total weight of the aqueous suspension of dispersed calcium carbonate. According to one preferred embodiment of the present invention, the aqueous suspension of dispersed calcium carbonate is a concentrated aqueous suspension of dispersed calcium carbonate, which preferably has a solid content between 70 wt.-% and 78 wt.-%, based on the total weight of the aqueous suspension of dispersed calcium carbonate.

In addition to calcium carbonate, the absorptive layer can comprise further mineral pigments or synthetic pigments. Examples for further mineral pigments comprise silica, alumina, titanium dioxide, clay, calcined clays, barium sulfate, or zinc oxide. Examples of synthetic pigments include plastic pigments, such as styrene pigments and Ropaque.

However, instead of calcium carbonate, the absorptive layer can comprise any other pigment, which, when in form of a compacted bed, has an absorption rate from $1\times10^{-5}$ $ms^{-0.5}$ to $1\times10^{-3}$ $ms^{-0.5}$ and/or a volume uptake of from 35 to 95%, preferably 40 to 70%, by volume relative to the total volume of the pigment.

According to an exemplary embodiment the pigment is a calcium carbonate, a plastic pigment such as a polystyrene-based plastic pigment, titanium dioxide, dolomite, calcined clay, or mixture thereof, or wherein the pigment is a mixture of calcium carbonate, titanium dioxide, dolomite, calcined clay or mixtures thereof with one or more of talc, non-calcined clay or bentonite, said pigment being preferably a calcium carbonate, more preferably a modified calcium carbonate and/or a precipitated calcium carbonate.

The amount of the pigment in the absorptive layer may be 40 to 99 wt.-%, e.g., from 45 to 98 w.-%, preferably between 60 and 97 wt.-% based on the total weight of the absorptive layer.

The absorptive layer can further contain a binder. Any suitable polymeric binder may be used in the absorptive layer of the invention. For example, the polymeric binder may be a hydrophilic polymer such as, for example, poly(vinyl alcohol), poly(vinyl pyrrolidone), gelatin, cellulose ethers, poly (oxazolines), poly(vinylacetamides), partially hydrolyzed poly(vinyl acetate/vinyl alcohol), poly(acrylic acid), poly (acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, starch, tragacanth, xanthan, or rhamsan and mixtures thereof. It is also possible to use other binders such as hydrophobic materials, for example, poly(styrene-co-butadiene), polyurethane latex, polyester latex, poly(n-butyl acrylate), poly(n-butyl methacrylate), poly(2-ethylhexyl acrylate), copolymers of n-butylacrylate and ethylacrylate, copolymers of vinylacetate and n-butylacrylate, and the like.

According to one embodiment, the binder is a natural binder selected from starch and/or polyvinyl alcohol. According to another embodiment, the binder is a synthetic binder selected from styrene-butadiene latex, styrene-acrylate latex, or polyvinyl acetate latex. The absorptive layer can also obtain mixtures of hydrophilic and latex binders, for example, a mixture of polyvinyl alcohol and styrene-butadiene latex.

According to one embodiment, the amount of binder in the absorptive layer is between 0 and 60 wt.-%, between 1 and 50 wt.-%, or between 3 and 40 wt.-%, based on the total weight of the pigment.

The absorptive layer may contain further, optional additives. Suitable additives can comprise, for example, dispersants, milling aids, surfactants, rheology modifiers, defoamers, optical brighteners, dyes, or pH controlling agents. According to one exemplary embodiment, the additive is a cationic additive, e.g. a cationic dye fixing agent, or a metal ion flocculent for pigmented inks.

According to an exemplary embodiment, the pigment is dispersed with a dispersant. The dispersant may be used in an amount from 0.01 to 10 wt.-%, 0.05 to 8 wt.-%, 0.5 to 5 wt.-%, 0.8 to 3 wt.-%, or 1.0 to 1.5 wt.-%, based on the total weight of the coating formulation. In a preferred embodiment, the pigment is dispersed with an amount of 0.05 to 5 wt.-%, and preferably with an amount of 0.5 to 5 wt.-% of a dispersant, based on the total weight of the coating formulation. As suitable dispersant is preferably selected from the group comprising homopolymers or copolymers of polycarboxylic acid salts based on, for example, acrylic acid, methacrylic acid, maleic acid, fumaric acid or itaconic acid and acrylamide or mixtures thereof. Homopolymers or copolymers of acrylic acid are especially preferred. The molecular weight $M_w$ of such products is preferably in the range of 2000-15000 g/mol, with a molecular weight $M_w$ of 3000-7000 g/mol being especially preferred. The molecular weight $M_w$ of such products is also preferably in the range of 2000 to 150000 g/mol, and an $M_w$ of 15000 to 50000 g/mol is especially preferred, e.g., 35000 to 45000 g/mol. According to an exemplary embodiment, the dispersant is polyacrylate.

The molecular weight of the milling aids and/or dispersants is selected so that they do not act as a binder but instead act as a parting compound. The polymers and/or copolymers may be neutralized with monovalent and/or polyvalent cations or they may have free acid groups. Suitable monovalent cations include, for example, sodium, lithium, potassium or ammonium. Suitable polyvalent cations include, for example, calcium, magnesium, strontium or aluminum. The combination of sodium and magnesium is especially preferred. Milling aids and/or dispersants such as sodium polyphosphates and/or polyaspartic acid as well as their alkali and/or alkaline earth salts, sodium citrate and amines, alkanolamines, such as triethanolamine and triisopropanolamine may also be used advantageously either alone or in combination with others. Dispersant based on organometallic compounds may also be employed. However, it is also possible to use any other dispersant.

The absorptive layer may have a thickness of at least 5 μm, e.g. at least 10 μm, 15 μm or 20 μm.

The absorptive layer can have a coat weight in a range from 3 to 50 $g/m^2$, 3 to 40 $g/m^2$, or 6 to 20 $g/m^2$.

Topcoat

A topcoat is in direct contact with the absorptive layer on the first side of the base layer, and optionally a second topcoat can be in direct contact with an optional second absorptive layer on the reverse side of the base layer. The purpose of the topcoat is to create a functional layer that acts as a filter for ink, catching the pigmented ink particles or adsorbing dye inks, but allowing the solvent to go through to be absorbed by the absorptive layer.

It was found by the inventors that the absorption capacity of a print medium can be increased by using an absorptive layer in combination with a topcoat having a certain permeability.

According to one embodiment, the topcoat has a permeability of greater than $5.0\times10^{-18}$ $m^2$, preferably from $5.0\times10^{-18}$ to $1.5\times10^{-14}$ $m^2$, or from $6.0\times10^{-18}$ to $1.3\times10^{-16}$ $m^2$.

According to one embodiment, the topcoat comprises a pigment. According to an exemplary embodiment, the pigment has a specific surface area from 5 to 200 $m^2/g$, e.g., from 10 to 30 $m^2/g$ or from 10 to 20 $m^2/g$.

According to one exemplary embodiment, a pigment with a very fine and narrow particle size distribution is used. Preferably, the quotient of the $d_{20}$ and $d_{75}$ value of the pigment, $d_{20}/d_{75}$, is from 5 to 60. More preferably, $d_{20}/d_{75}$ is from 10 to 50, and even more preferably $d_{20}/d_{75}$ is from 15 to 40.

The pigment, for example, may feature a $d_{50}$ value from about 0.01 to 5.0 μm, from about 0.1 to 5.0 μm, from about 0.2 to 4.0 μm, or from about 0.25 to 3.5 μm. Preferably, the pigment has a $d_{50}$ value from about 0.3 to 3.0 μm.

According to one embodiment of the present invention, the pigment is a mineral pigment. The mineral pigment may be a calcium carbonate, for example, being in the form of a ground calcium carbonate, a modified calcium carbonate or a precipitated calcium carbonate, or a mixture thereof. A natural ground calcium carbonate may feature, e.g., one or more of marble, limestone, chalk, and/or dolomite. A precipitated calcium carbonate may feature, e.g., one or more of aragonitic, vateritic and/or calcitic mineralogical crystal forms. Aragonite is commonly in the acicular form, whereas vaterite belongs to the hexagonal crystal system. Calcite can form scalenohedral, prismatic, spheral, and rhombohedral forms. A modified calcium carbonate may feature a natural ground or precipitated calcium carbonate with an internal structure modification or a surface-reaction product. Such surface-reacted products may, for example, be prepared according to WO 00/39222, WO 2004/083316, WO 2005/121257, WO 2009/074492, unpublished European patent application with filing number 09162727.3, and unpublished European patent application with filing number 09162738.0.

Preferably the mineral pigment is a modified calcium carbonate or a precipitated calcium carbonate, or a mixture thereof. Examples of calcium carbonates that may be used in the topcoat of the present invention are described, e.g., in EP 1712523 or U.S. Pat. No. 6,666,953.

According to one embodiment the calcium carbonate is in acicular, prismatic, spheral, or rhombohedral form or any combination thereof.

According to one embodiment, the calcium carbonate will be derived from an aqueous suspension of dispersed calcium carbonate. According to one embodiment of the present invention, the aqueous suspension of dispersed calcium carbonate has a solid content of between 10 wt.-% and 82 wt.-%, preferably between 50 wt.-% and 81 wt.-%, and more preferably between 70 wt.-% and 78 wt.-%, based on the total weight of the aqueous suspension of dispersed calcium carbonate. According to one preferred embodiment of the present invention, the aqueous suspension of dispersed calcium carbonate is a concentrated aqueous suspension of dispersed calcium carbonate, which preferably has a solid content between 70 wt.-% and 78 wt.-%, based on the total weight of the aqueous suspension of dispersed calcium carbonate.

In addition to calcium carbonate, the topcoat can comprise further mineral or synthetic pigments. Examples for further mineral pigments comprise silica, alumina, titanium dioxide, clay, calcined clays, barium sulfate, or zinc oxide. Examples of synthetic pigments include plastic pigments, such as styrene pigments and Ropaque. However, instead of calcium carbonate, the topcoat can comprise any other pigment as long as the topcoat has a permeability of greater than $5.0\times10^{-18}$ $m^2$.

According to an exemplary embodiment the pigment is a calcium carbonate, a plastic pigment such as a polystyrene-based plastic pigment, titanium dioxide, dolomite, calcined clay, or mixture thereof, or wherein the pigment is a mixture of calcium carbonate, titanium dioxide, dolomite, calcined clay or mixtures thereof with one or more of talc, non-calcined clay or bentonite, said pigment being preferably a calcium carbonate, more preferably a modified calcium carbonate and/or a precipitated calcium carbonate.

The amount of the pigment in the topcoat may be more than 50 wt.-%, e.g, between 50 and 99 wt.-%, preferably between 60 and 98 wt.-%, more preferably between 70 and 90 wt.-%, based on the total weight of the topcoat.

Furthermore, the topcoat may contain a binder. Any suitable polymeric binder may be used in the topcoat of the invention. For example, the polymeric binder may be a hydrophilic polymer such as, for example, poly(vinyl alcohol), poly(vinyl pyrrolidone), gelatin, cellulose ethers, poly(oxazolines), poly(vinylacetamides), partially hydrolyzed poly (vinyl acetate/vinyl alcohol), poly(acrylic acid), poly(acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, starch, tragacanth, xanthan, or rhamsan and mixtures thereof. It is also possible to use other binders such as hydrophobic materials, for example, poly(styrene-co-butadiene), polyurethane latex, polyester latex, poly(n-butyl acrylate), poly(n-butyl methacrylate), poly(2-ethylhexyl acrylate), copolymers of n-butylacrylate and ethylacrylate, copolymers of vinylacetate and n-butylacrylate, and the like.

According to one embodiment, the binder is a natural binder selected from starch and/or polyvinyl alcohol. According to another embodiment, the binder is a synthetic binder selected from styrene-butadiene latex, styrene-acrylate latex, or polyvinyl acetate latex. The topcoat can also obtain mixtures of hydrophilic and latex binders, for example, a mixture of polyvinyl alcohol and styrene-butadiene latex. Preferably, the formulated layer from the chosen pigment and binder should not be rendered impermeable by the use of the binder. Particularly, this may be relevant for soluble binders.

According to one embodiment, the amount of binder in the topcoat is between 0 and 60 wt.-%, between 0.5 and 50 wt.-%, 1 and 40 wt.-%, 2 and 30 wt.-%, or 3 and 20 wt.-%, based on the total weight of the pigment. In a preferred embodiment, the topcoat contains about 5 wt.-% of a binder, preferably styrene-butadiene latex, based on the total weight of the pigment.

The topcoat may contain further, optional additives. Suitable additives can comprise, for example, dispersants, milling aids, surfactants, rheology modifiers, defoamers, optical brighteners, dyes, or pH controlling agents. According to an exemplary embodiment, the topcoat further comprises a rheology modifier to improve the runnability of the coating formulation. The rheology modifier may be present in an amount between 0 and 60 wt.-%, between 0.1 and 50 wt.-%, 0.2 and 40 wt.-%, 0.3 and 30 wt.-%, or 0.5 and 20 wt.-%, based on the total weight of the pigment. According to an exemplary embodiment, the rheology modifier is present in an amount less than 1 wt.-% based on the total weight of the pigment, e.g., in an amount between 0.1 to 0.9 wt.-%, between 0.2 and 0.8 wt.-%, or about 0.5 wt.-%. According to a further exemplary embodiment, the topcoat further comprises a cationiser or anioniser.

The topcoat may have a thickness of at least the diameter of the largest mineral and/or synthetic pigment in the topcoat. According to one embodiment, the thickness of the topcoat is between 10 nm and 30 μm or between 1 μm and 18 μm, or between 4 μm and 10 μm.

The topcoat can have a coat weight in a range from 1 to 50 $g/m^2$, 3 to 40 $g/m^2$, or 6 to 20 $g/m^2$.

Manufacture of Print Medium

According to one embodiment a method for manufacturing a print medium comprises the following steps: (a) providing a base layer having a first side and a reverse side, (b) applying a first liquid coating formulation to form an absorptive layer on the first side of the base layer, (c) applying a second liquid coating formulation onto the absorptive layer to form a topcoat, and (d) drying the absorptive layer and the topcoat, wherein the absorptive layer and the topcoat are either dried simultaneously or the absorptive layer is dried after step b) and before applying the topcoat according to step c), wherein the topcoat has a permeability of greater than $5.0\times10^{-18}$ $m^2$.

According to one embodiment, steps (b), (c), and (d) are also carried out on the reverse side of the base layer to manufacture a print medium being coated on the first side and the reverse side. These steps may be carried out for each side separately or may be carried out on the first and the reverse side simultaneously.

According to one embodiment of the inventive method, the absorptive layer and the topcoat are dried simultaneously. According to another embodiment of the inventive method, the absorptive layer is dried after step b) and before applying the topcoat according to step c).

According to another embodiment, the first liquid coating composition comprises a pigment, which, when in the form of a compacted bed, has an absorption rate from $1\times10^{-5}$ $ms^{-0.5}$ to $1\times10^{-3}$ $ms^{-0.5}$ and/or a volume uptake of from 35 to 95%, preferably 40 to 70%, by volume relative to the total volume of the pigment.

The absorptive layer and the topcoat may be applied onto the base layer by conventional coating means commonly used in this art. Suitable coating methods are, e.g., air knife coating, electrostatic coating, meter size press, film coating, spray coating, wound wire rod coating, slot coating, slide hopper coating, gravure, curtain coating, high speed coating and the like. Some of these methods allow for simultaneous coatings of two or more layers, which is preferred from a manufacturing economic perspective.

In an exemplary embodiment the coating formulations are applied by high speed coating, meter size press, curtain coating, spray coating or electrostatic coating. In a preferred embodiment, high speed coating is used to apply the absorptive layer and/or the topcoat. In another preferred method, curtain coating is used to apply the absorptive layer and the topcoat simultaneously. Curtain coating can also be used to apply the absorptive layer and the topcoat subsequently.

According to an exemplary embodiment, the first liquid coating formulation used to form an absorptive layer further contains a dispersant, e.g., polyacrylate, in an amount of 0.05 to 5 wt.-%, preferably in an amount of 0.5 to 5 wt.-%, based on total weight of the pigment.

According to another exemplary embodiment, the coating formulations are prepared using aqueous suspension of dispersed calcium carbonate having a solid content of between 10 wt.-% and 82 wt.-%, preferably between 50 wt.-% and 81 wt.-%, and more preferably between 70 wt.-% and 78 wt.-%, based on the total weight of the aqueous suspension of dispersed calcium carbonate. According to one preferred embodiment of the present invention, the coating formulations are prepared using aqueous suspension of dispersed calcium carbonate having a solid content between 70 wt.-% and 78 wt.-%, based on the total weight of the aqueous suspension of dispersed calcium carbonate.

The coating formulations may have a Brookfield viscosity in the range of 20 to 3000 mPas, preferably from 250 to 3000 mPas, and more preferably from 1000 to 2500 mPas.

After being dried, the absorptive layer can be further treated before applying the topcoat. According to one embodiment, the absorptive coating is calendered before applying the topcoat.

After coating, the print medium may be subject to calendering or super-calendering to enhance surface smoothness. For example, calendering may be carried out at a temperature from 20 to 200° C., preferably from 60 to 100° C. using, for example, a calender having 2 to 12 nips. Said nips may be hard or soft, hard nips for example made of a ceramic material. According to one exemplary embodiment, the double-coated printing medium is calendered at 300 kN/m to obtain a glossy coating.

According to another exemplary embodiment, the double-coated printing medium is calendered at 120 kN/m to obtain a matt coating.

EXAMPLES

The following examples show different test papers which were prepared and an inkjet recording quality test, carried out using Kodak stream ink on a Kodak EASYSHARE 5500.

For the determination of the weight median particle size $d_{50}$, for particles having a $d_{50}$ greater than 0.5 μm, a Sedigraph 5100 device from the company Micromeritics, USA was used. The measurement was performed in an aqueous solution of 0.1 wt.-% $Na_4P_2O_7$. The samples were dispersed using a high-speed stirrer and ultrasound. For the determination of the volume median particle size for particles having a $d_{50}\leq500$ nm, a Malvern Zetasizer Nano ZS from the company Malvern, UK was used. The measurement was performed in an aqueous solution of 0.1 wt % $Na_4P_2O_7$. The samples were dispersed using a high-speed stirrer and ultrasound.

The Brookfield viscosity was measured using a Brookfield DVII+ viscometer at 100 rpm and 23° C. Pigment brightness and paper opacity were measured using an ELREPHO 3000 from the company Datacolor according to ISO 2496. Air permeance was determined using a LW Airpermeance Tester from Lorentzen & Wettre according to ISO 5636-5. Rub resistance against black paper was determined using a Quartant-rub tester according to the following method: the coated paper is applied against a black tinted "Folia" drawing paper from Max Bringmann KG (Germany) under a weight of 600 g and the coated paper is rotated against the black paper. Paper Gloss was measured using LGDL-05.3-lab instrumentation from the company Lehmann Messsysteme GmbH, DE-Koblenz according to ISO 8254-1 Optical print density was measured using a Gretag-Macbeth Spektrolino, according to DIN Norm 16536-2. The mottling and color to color bleed was determined using a PaPEye software solution with internal test procedure developed by Omya AG.

A compacted bed or tablet formulation of a pigment was formed by applying a constant pressure (usually 15 bar) to the pigment suspension or slurry for several hours such that water is released by filtration through a fine 0.025 μm filter membrane resulting in a compacted bed or tablet of the pigment with a diameter of 2.5 cm and a thickness of 1 to 1.5 cm. The apparatus used is shown schematically in Ridgway et al. "Modified calcium carbonate coatings with rapid absorption and extensive liquid uptake capacity" (Colloids and Surfaces A: Physiochem. and Eng. Asp. 2004, 236(1-3), 91-102). The tablets were removed from the apparatus and dried in an oven at 60° C. for 24 hours.

According to Schoelkopf et al. "Measurement and network modelling of liquid permeation into compacted mineral blocks" (Journal of Colloid and Interface Science 2000, 227 (1), 119-131) for the measurement of the "absorption rate", compacted bed samples were coated with a thin barrier line of silicone around the base of the vertical edges arising from the basal plane to reduce artefacts caused by the wetting of their outer surfaces. The remainder of the outer planes were not coated, to allow for the free movement of displaced air or liquid during absorption, and to minimise any interaction between the silicone and the absorbed liquid. Once the sample is lowered to contact the absorbing fluid source, the weight loss from the dish is continually recorded using an automated microbalance, namely a PC-linked Mettler Toledo AX504 balance with a precision of 0.1 mg, capable of 10 measurements per second, accounting for any evaporation if present. When the recorded weight is constant, indicative of absorption-saturation, the measurement is complete. Knowing the sample weight before and after the absorption measurement allows the intruded volume per gram of sample to be calculated. (Dividing the weight difference by the density of the liquid gives the volume intruded into the sample, and hence the volume per gram of sample).

According to Ridgway et al. "A new method for measuring the liquid permeability of coated and uncoated papers and boards" (Nordic Pulp and Paper Research Journal 2003, 18(4), 377-381) for measuring the permeability, measurement samples were prepared by placing a cuboidal piece of a tablet (compacted bed) structure having an area of 15 mm×15 mm and a height of 10 mm into a PTFE-mould and pouring the resin Technovit 4000 (Heraeus GmbH, Wherheim/Ts, Germany) around it to produce a sample disk having a diameter of 30 mm. The quickly rising viscosity of the chosen curing resin results in a penetration of approximately 1 mm locally at the outer boundaries of the sample. This penetration depth is clearly visible because of the opacity change at the edge of the sample and can, therefore, be calibrated. The open area of the porous sample, i.e. that free from resin, is evaluated so that the permeable cross-sectional area can be established. The sample discs are placed in a dish containing the probe liquid in order to saturate the void network of the sample before placing in the apparatus. Hexadecane was used in the experiments with density, $\rho=773\ kgm^{-3}$ and viscosity, $\eta=0.0034\ kgm^{-1}\ s^{-1}$ to avoid any interaction with synthetic or natural binders if present. The sample disc is then placed in a specially constructed pressure cell. The cell design used for the pressurised permeability experiments is described in Ridgway et al. (Nordic Pulp and Paper Research Journal 2003, 18(4), 377-381). Gas over-pressure is supplied from a nitrogen bottle. The pressure cell is fixed over a Mettler Toledo AX504 microbalance and a PC samples the balance data using specially-developed software developed within Omya AG. A drop captor device was needed in the base of the cell to guide the permeated liquid drops to the outlet. An important point of practical technique is that the whole chamber below the position of the sample has to be pre-wetted with the liquid so that each drop leaving the sample causes a drop to fall into the sampling dish. Once these precautions are taken the continuity of flow is ensured.

All results obtained for the porosity measurement are corrected using the software Pore-Comp for mercury and penetrometer effects and also for sample skeletal compression. A detailed description of the mercury porosity measurement method can be found in Gane et al. "Void space structure of compressible polymer spheres and consolidated calcium carbonate paper-coating formulations" (Industrial & Engineering Chemistry Research Journal 1996, 35(5), 1753-1764).

Table 1 shows the properties of the pigments used to produce the coating formulations characterized in Table 2. P1 is a commercially available ground calcium carbonate, P 2 is a commercially available modified calcium carbonate, P3 is a commercially available mixture of fine ground calcium carbonate and precipitated calcium carbonate.

TABLE 1

Pigment properties.

| | P1 | P2 | P3 |
|---|---|---|---|
| Specific surface area (BET) [$m^2/g$] | 11.8 | 27.4 | 19.1 |
| Weight median particle size ($d_{50}$) [μm] | 0.71 | 1.27 | 0.29 |
| Pigment brightness (R457 TAPPI) [%] | 95.5 | 91.9 | 93.5 |
| Brookfield viscosity at 100 $min^{-1}$ [mPas] | 760 | 520 | 1740 |
| Solids content [%] | 77.8 | 50.0 | 72.1 |
| pH value | 8.3 | 8.5 | 9.7 |
| Absorption rate [$ms^{-0.5}$] (in form of a compacted bed) | — | $4.43 \times 10^{-5}$ | — |
| Volume uptake [$cm^3/g$] (in form of a compacted bed) | 0.134 | 0.281 | 0.178 |
| Volume uptake [%] (in form of a compacted bed) | 26.3 | 42.7 | 31.8 |
| Permeability [$m^2$] (in form of a compacted bed) | $2.93 \times 10^{-17}$ | — | $8.5 \times 10^{-18}$ |

The foregoing pigments were used to prepare three different coating formulations (see Table 2) to demonstrate the invention. Formulation A comprises pigment P1 and 11 wt.-% of a styrene-butadiene latex and 0.5 wt.-% of a carboxymethyl cellulose, based on the weight of the pigment. Formulation A is a coating formulation typically used for offset coatings. Formulation B is an absorptive layer formulation according to the invention and comprises pigment P2, 3 wt.-% polyvinylalcohol, 3 wt.-% starch, and 5 wt.-% of a cationic additive as dye fixing agent, based on the weight of the pigment. Formulation C is a topcoat formulation according to the invention and comprises pigment P3, 5 wt.-% of a styrene-butadiene latex and 0.5 wt.-% of a carboxymethyl cellulose, based on the weight of the pigment, i.e. formulation C is very similar to offset formulation A, e.g., it is negatively charged. However, when compared to formulation A, the used pigment is different and the amount of binder has been reduced.

TABLE 2

Properties of the coating formulations.

| | A (P1) | B (P2) | C (P3) |
|---|---|---|---|
| Solids content [%] | 69.7 | 45.4 | 68.1 |
| Brookfield viscosity at 100 $min^{-1}$ [mPas] | 2020 | 420 | 1640 |
| Charge [μVal/g] | −130 | 294 | −130 |
| Absorption rate [$ms^{-0.5}$] (in form of a compacted bed) | — | $2.95 \times 10^{-5}$ | — |
| Volume uptake [$cm^3/g$] (in form of a compacted bed) | 0.122 | 0.203 | 0.166 |
| Porosity of the coating layer [%] (in form of a compacted bed) | 23.9 | 33.9 | 29.7 |
| Permeability [$m^2$] (in form of a compacted bed) | $7.89 \times 10^{-17}$ | — | $1.56 \times 10^{-17}$ |

The coating formulations A to C were coated onto Sappi Magnostar paper sheets having a weight of 58 $g/m^2$ using a pilot paper coater machine at speed of 1500 m/min. To prepare double coated paper sheets having an absorptive layer and a topcoat, paper sheets with coated with formulation B were overcoated with top coating formulation C. The coated paper sheets were calendered at 300 kN/m to provide a glossy surface. Table 3 shows the different glossy test papers that were prepared.

TABLE 3

Properties of coated papers having a glossy surface.

| | A | B | B + C (8 $g/m^2$) | B + C (15 $g/m^2$) |
|---|---|---|---|---|
| Grammage [$g/m^2$] | 79.9 | 80.0 | 101.7 | 109.0 |
| Thickness [μm] | 63 | 64 | 79 | 86 |
| Gloss-lab (75°TAPPI) [%] | 59.0 | 43.0 | 71.0 | 76.0 |
| +UV brightness R 457 [%] | 89.5 | 88.1 | 89.3 | 89.4 |
| −UV brightness R 457 [%] | 85.5 | 84.6 | 87.0 | 87.5 |
| Paper opacity [%] | 85.7 | 86.3 | 91.4 | 92.8 |
| PPS roughness [μm] | 1.08 | 1.28 | 1.04 | 0.83 |
| Air permeance [ml/min] | 2 | 7 | 5 | 5 |
| Rub resistance against black paper [Ry] | 0.02 | 0.00 | 0.05 | 0.06 |

A comparison of the gloss values measured for the tested coated papers having a glossy surface is shown in FIG. 1. It can be observed from this figure that the inkjet formulation B leads to significantly lower gloss values when compared with the offset formulation A. Furthermore, it can be seen that the double coated papers having coatings B+C achieve extremely high gloss values, indicating that these papers may compete successfully against offset glossy papers.

Furthermore, the print quality was evaluated by measuring optical density and mottling for black and white and for color printing as well as the color to color bleed. The results are compiled in Table 4 as well as in FIG. 2 to FIG. 7.

TABLE 4

Optical density, mottling and color to color bleed values measured for coated paper having a glossy surface. Mottling values are unitless values.

| | A | B | B + C (8 $g/m^2$) | B + C (15 $g/m^2$) |
|---|---|---|---|---|
| Density black [%] | 6.6 | 6.1 | 4.9 | 4.9 |
| Density color [%] | 4.2 | 4.5 | 4.6 | 4.6 |

TABLE 4-continued

Optical density, mottling and color to color bleed values measured for coated paper having a glossy surface. Mottling values are unitless values.

| | A | B | B + C (8 $g/m^2$) | B + C (15 $g/m^2$) |
|---|---|---|---|---|
| Color to color bleed [$mm^2$] | 104.1 | 84.0 | 79.3 | 77.7 |
| Mottling black | 4.1 | 6.9 | 5.7 | 5.9 |
| Mottling color | 48.8 | 9.0 | 3.6 | 3.1 |

Figure 5:
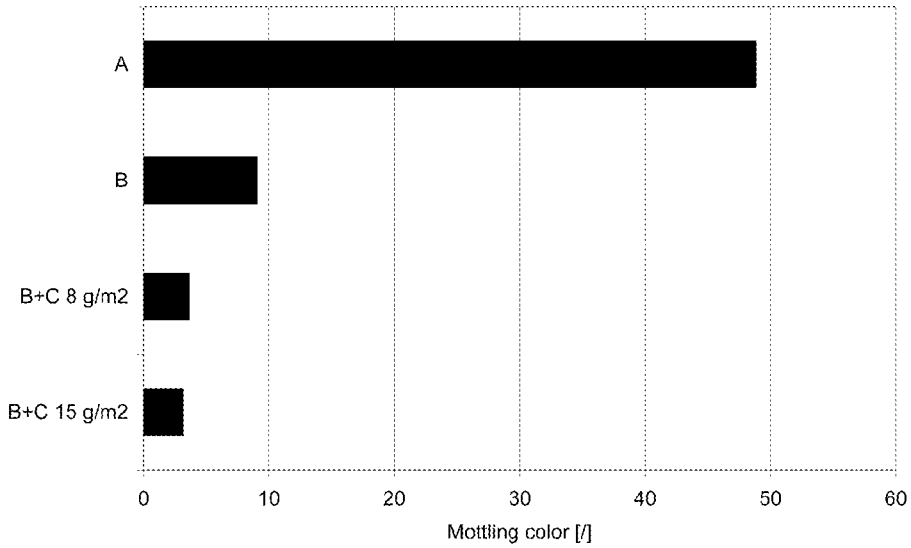
FIG. 5 shows the mottling upon color inkjet printing that was measured for paper sheets having different coating formulations.
Figure 6:
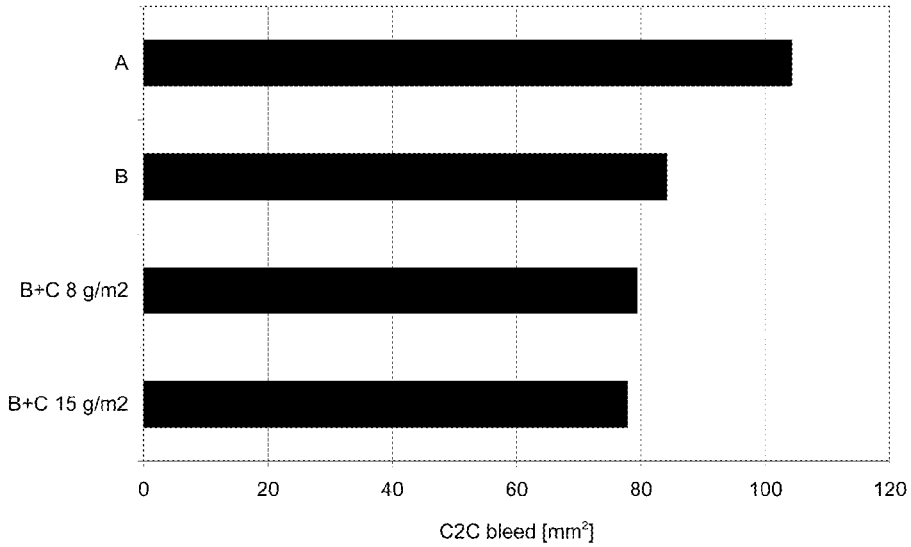
FIG. 6 shows the color to color (c2c) bleed upon color inkjet printing that was measured for paper sheets having different coating formulations.

The results show that color printing on papers having an offset coating (coating formulation A) creates unacceptable print quality, seen as extremely high mottling values (see FIG. 5, formulation A). In contrast, the double coated paper according to the invention provides superior color print image (see FIG. 6, formulations B+C (8 $g/m^2$) and B+C (15 $g/m^2$)).

Figure 7:
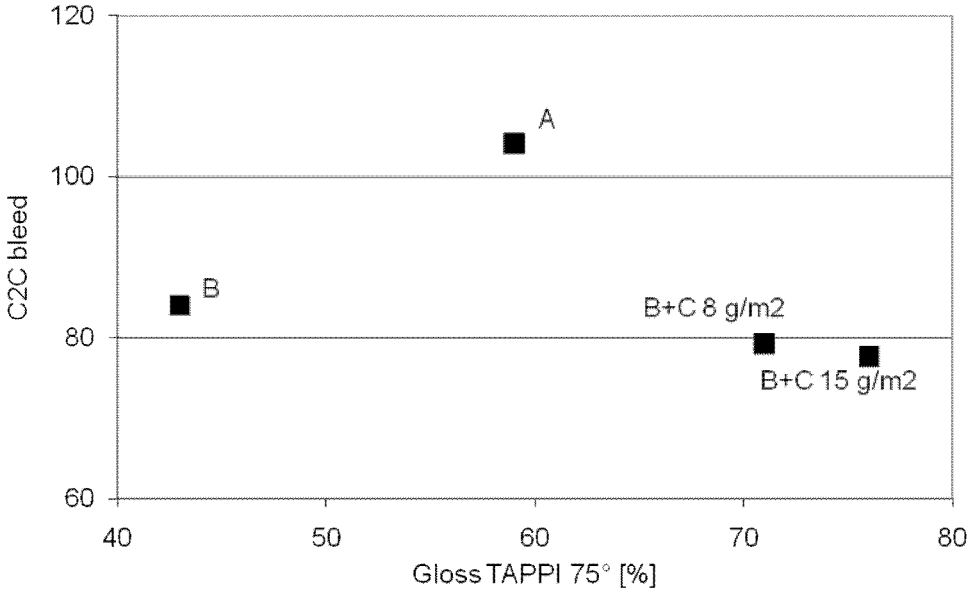
FIG. 7 shows the color to color (c2c) bleed upon color inkjet printing versus the paper gloss that was measured for paper sheets having different coating formulations.

FIG. 7 shows a plot of the color to color bleed at color inkjet printing versus the paper gloss that was measured for paper sheets having different glossy coating formulations. It can be gathered from FIG. 7 that a typical inkjet coating (formulation B) decreases significantly the glossing potential of the coating but improves the color to color bleed. Anionic coatings (formulations A, B+C (8 $g/m^2$) and B+C (15 $g/m^2$)) and heavy calendering can provide very good gloss and absorption properties. However, the typical offset coating (formulation A), shows an unacceptable color to color bleed (a value of more than 90 $mm^2$ is typically unacceptable), and thus is not suitable for inkjet printing.

The invention claimed is:

1. A print medium comprising:

a) a base layer having a first side and a reverse side;

b) an absorptive layer being in contact with the first side of the base layer, wherein the adsorptive layer comprises a pigment; and c) a topcoat being in contact with the absorptive layer, wherein the topcoat has a permeability of greater than $5.0 \times 10^{-18}$ $m^2$, and comprises a pigment having a $d_{50}$ value in a range from 0.01 to 1.0 μm.

2. The print medium of claim 1, wherein the base layer is a wood free paper or a wood containing paper.

3. The print medium of claim 2, having a basis weight from 30 to 300 $g/m^2$.

4. The print medium of claim 1, wherein the absorptive layer has an absorption rate from $1 \times 10^{-5}$ $ms^{-0.5}$ to $1 \times 10^{-3}$ $ms^{-0.5}$ and/or a volume uptake from 30 to 95% by volume relative to the total volume of the absorptive layer.

5. The print medium of claim 1, wherein the pigment of the absorptive layer, when in the form of a compacted bed, has an absorption rate from $1 \times 10^{-5}$ $ms^{-0.5}$ to $1 \times 10^{-3}$ $ms^{-0.5}$ and/or a volume uptake from 35 to 95% by volume relative to the total volume of the pigment.

6. The print medium of claim 1, wherein the pigment of the absorptive layer has a specific surface area of greater than 25 $m^2/g$.

7. The print medium of claim 1, wherein the pigment of the absorptive layer has a specific surface area of from 25 to 100 $m^2/g$.

8. The print medium of claim 1, wherein the pigment of the absorptive layer has a specific surface area of from 30 to 50 $m^2/g$.

9. The print medium of claim 1, wherein the pigment of the absorptive layer has a specific surface area of greater than 25 $m^2/g$, a $d_{50}$ value from 0.3 to 3 μm and a porosity, when in form of a compacted bed, of greater or equal to 35%.

10. The print medium of claim 1, wherein the pigment of the absorptive layer is a calcium carbonate, a plastic pigment, a polystyrene-based plastic pigment, titanium dioxide, dolomite, calcined clay, or any mixture thereof, or a mixture of one or more of calcium carbonate, titanium dioxide, dolomite, or calcined clay with one or more of talc, non-calcined clay or bentonite.

11. The print medium of claim 1, wherein the pigment of the absorptive layer is a calcium carbonate.

12. The print medium of claim 1, wherein the pigment of the absorptive layer is a modified calcium carbonate and/or a precipitated calcium carbonate.

13. The print medium of claim 11, wherein the calcium carbonate is in acicular, prismatic, spheral, or rhombohedral form or any combination thereof.

14. The print medium of claim 1, wherein the absorptive layer further comprises a binder in an amount of 1 to 50 wt.-% based on the total weight of the pigment.

15. The print medium of claim 14, wherein the binder is starch, polyvinyl alcohol, styrene-butadiene latex, styrene-acrylate latex, or polyvinyl acetate latex or any mixture thereof.

16. The print medium of claim 1, wherein the absorptive layer has a coat weight in a range from 3 to 50 $g/m^2$.

17. The print medium of claim 1, wherein the absorptive layer has a coat weight in a range from 3 to 40 $g/m^2$.

18. The print medium of claim 1, wherein the absorptive layer has a coat weight in a range from 6 to 20 $g/m^2$.

19. The print medium of claim 1, wherein the pigment of the topcoat is a calcium carbonate, a plastic pigment, a polystyrene-based plastic pigment, titanium dioxide, dolomite, calcined clay, or any mixture thereof, or a mixture of one or more of calcium carbonate, titanium dioxide, dolomite, or calcined clay with one or more of talc, non-calcined clay or bentonite.

20. The print medium of claim 1, wherein the pigment of the topcoat is a calcium carbonate.

21. The print medium of claim 1, wherein the pigment of the absorptive layer comprises ground calcium carbonate and/or a precipitated calcium carbonate.

22. The print medium of claim 1, wherein the topcoat further contains a binder in an amount of 0.5 to 50 wt.-% based on the total weight of the pigment.

23. The print medium of claim 22, wherein the binder is selected from starch, polyvinyl alcohol, styrene-butadiene latex, styrene-acrylate latex, or polyvinyl acetate latex or any mixture thereof.

24. The print medium of claim 1, wherein the topcoat further comprises a rheology modifier in an amount of less than 1 wt.-% based on the total weight of the pigment.

25. The print medium of claim 1, wherein the topcoat has a coat weight in a range from 1 to 50 $g/m^2$.

26. The print medium of claim 1, wherein the topcoat has a coat weight in a range from 3 to 40 $g/m^2$.

27. The print medium of claim 1, wherein the topcoat has a coat weight in a range from 6 to 20 $g/m^2$.

28. The print medium of claim 1, wherein the print medium further comprises a second absorptive layer being in contact with the reverse side of the base layer, and a second topcoat being in contact with the second absorptive layer.

* * * * *